US007056007B2

(12) United States Patent
Chiu

(10) Patent No.: US 7,056,007 B2
(45) Date of Patent: Jun. 6, 2006

(54) TRACK LAMP ASSEMBLY AND DISPLAY WITH THE TRACK LAMP ASSEMBLY

(76) Inventor: Hwa Jung Chiu, 10F, No. 68, Chung Cheng Rd., Hsin Chuang City, Taipei Hsien (TW)

( * ) Notice: Subject to any disclaimer, the term of this patent is extended or adjusted under 35 U.S.C. 154(b) by 155 days.

(21) Appl. No.: 10/844,412

(22) Filed: May 13, 2004

(65) Prior Publication Data

US 2005/0254262 A1 Nov. 17, 2005

(51) Int. Cl.
*H01R 33/00* (2006.01)

(52) U.S. Cl. ..... 362/648; 362/125

(58) Field of Classification Search ..... 362/125, 362/132, 145, 147, 647–649, 418, 449; 439/110, 439/332; 248/235; 312/307; 211/193, 162
See application file for complete search history.

(56) References Cited

U.S. PATENT DOCUMENTS 4,907,137 A * 3/1990 Schladitz et al. ..... 362/145
5,584,576 A * 12/1996 Wei Hong ..... 362/396
5,833,358 A * 11/1998 Patik ..... 362/391
6,869,209 B1 * 3/2005 Layne et al. ..... 362/404

* cited by examiner

*Primary Examiner*—Ali Alavi
(74) *Attorney, Agent, or Firm*—Rosenberg, Klein & Lee

(57) ABSTRACT

A track lamp assembly and a display with the track lamp assembly are described. The track lamp assembly has a track subassembly and a track lamp. The display with a track lamp assembly has a track subassembly, a support mechanism, a shelf and a track lamp. The track subassembly has a track. The track has a base. A plurality of elongate holes is defined in the base along a longitudinal direction of the track. The support mechanism is attached to some of the elongate holes of the track. The shelf is positioned at the support mechanism. The track lamp is attached to one of the elongate holes of the track, whereby the track lamp assembly is assembled to form a display. Thus, it is ready to assemble a display with a good shape.

9 Claims, 11 Drawing Sheets

TRACK LAMP ASSEMBLY AND DISPLAY WITH THE TRACK LAMP ASSEMBLY

BACKGROUND OF THE INVENTION

1. Field of the Invention

The present invention relates to a track lamp assembly and a display with the track lamp assembly, and particularly to a track lamp assembly and a display with the track lamp assembly, which is assembled to form the display.

2. Description of the Related

As is well known, a track lamp assembly includes a track subassembly and a track lamp. The track subassembly has two electrically conductive strips. The track lamp electrically connects with the electrically conductive strips when the track lamp is attached to the track subassembly at different positions. Therefore, the mounting position and lighting range of the lamp is flexible and so is fit to illuminate goods in a display.

A conventional track lamp assembly is attached to an attaching surface of a display, such as a clapboard of the display, through a track subassembly thereof for illuminating goods in the display.

However, it is complicated and time-consuming to attach the track subassembly of the conventional track lamp assembly to the clapboard of the display. Furthermore, as a whole, the display is not visually attractive.

Therefore, it is required to improve the conventional track lamp assembly having the above-mentioned shortcomings.

SUMMARY OF THE INVENTION

Accordingly, an object of the present invention is to provide a track lamp assembly and a display with the track lamp assembly, which is assembled to form the display, whereby it is ready to assemble the display with a good shape.

To achieve the above-mentioned object, a track lamp assembly in accordance with the present invention includes a track subassembly and a track lamp. The track subassembly includes a track, a pair of insulating bushings and a pair of electrically conductive strips. The track has a base and a pair of sidewalls respectively extending from opposite side edges of the base. A plurality of elongate holes is defined in the base along a longitudinal direction of the track. The insulating bushings are respectively assembled on the sidewalls. The electrically conductive strips are respectively received in the insulating bushings. The track lamp includes an adapter. The adapter has a body, a post extending from an upper surface of the body, a pair of securing boards oppositely projecting from side annular surfaces of the post, and a pair of contacts. A gap is defined between the upper surface and the securing boards. An end of each contact projects from the side annular surface of the post above the securing board. The post extends into one of the elongate holes of the track. The base is secured between the upper surface of the body and the securing boards by rotating the body. The contacts are electrically connected with the electrically conductive strips, respectively.

A display with a track lamp assembly in accordance with the present invention includes a track subassembly, a support mechanism, a shelf and a track lamp. The track subassembly includes a track. The track has a base. A plurality of elongate holes is defined in the base along a longitudinal direction of the track. The support mechanism is attached to some of the elongate holes of the track. The shelf is positioned on the support mechanism. The track lamp is attached to one of the elongate holes of the track.

The track lamps and the support mechanisms are attached to the tracks through the plurality of elongate holes defined in the bases of the tracks of the track subassemblies, whereby the track lamp assembly is assembled to form a display. Thus, it is ready to assemble a display with a good shape.

BRIEF DESCRIPTION OF THE DRAWINGS

Other objects, advantages and novel features of the present invention will be drawn from the following detailed embodiments of the present invention with attached drawings, in which.

DETAILED DESCRIPTION OF PREFERRED EMBODIMENTS

Figure 1:
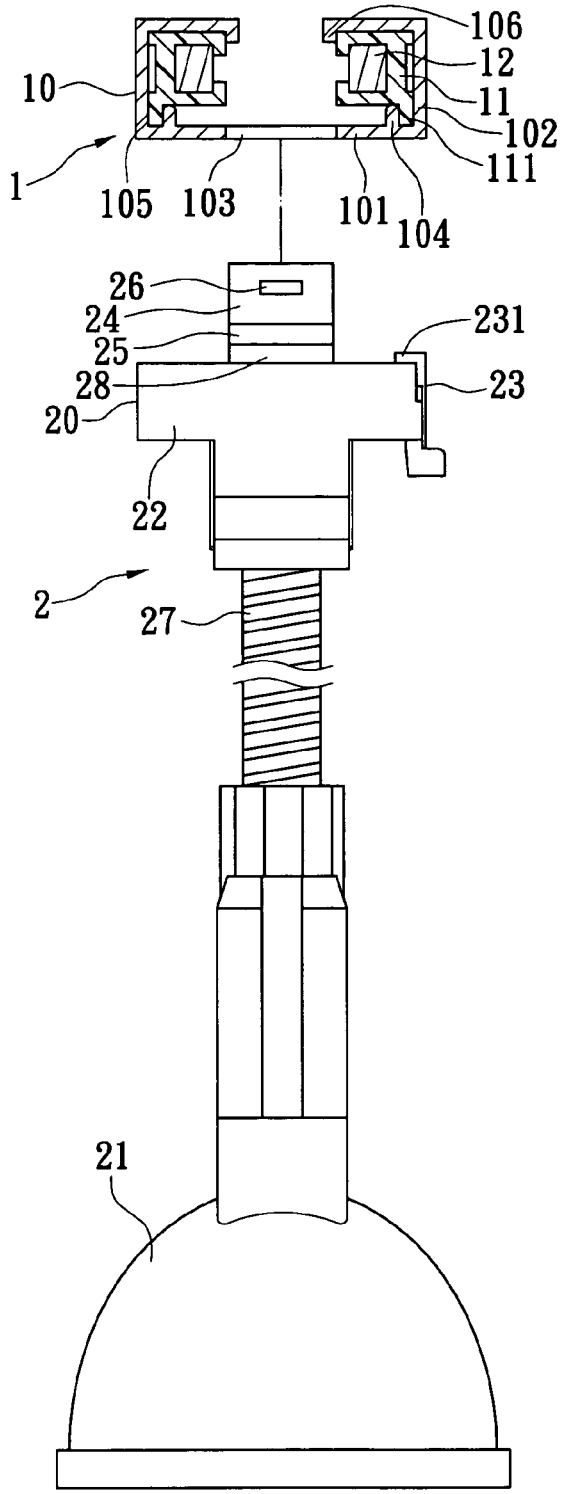
FIG. 1 is a cross-sectional and exploded view of a track lamp assembly of the present invention.
Figure 2:
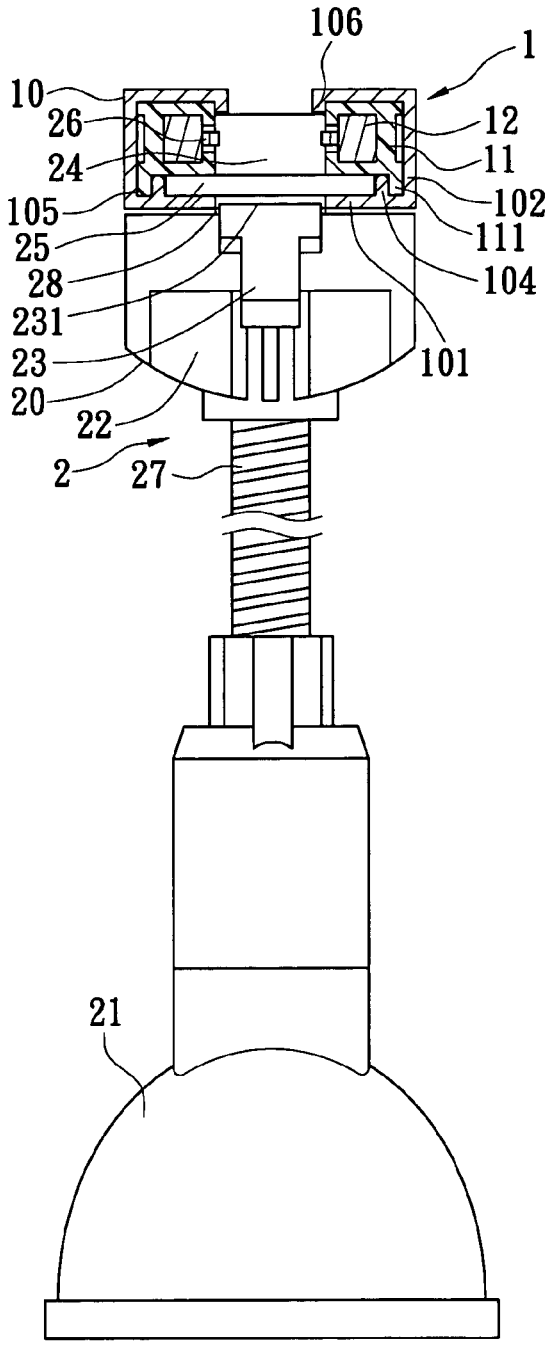
FIG. 2 is a cross-sectional and assembled view of the track lamp assembly.
Figure 3:
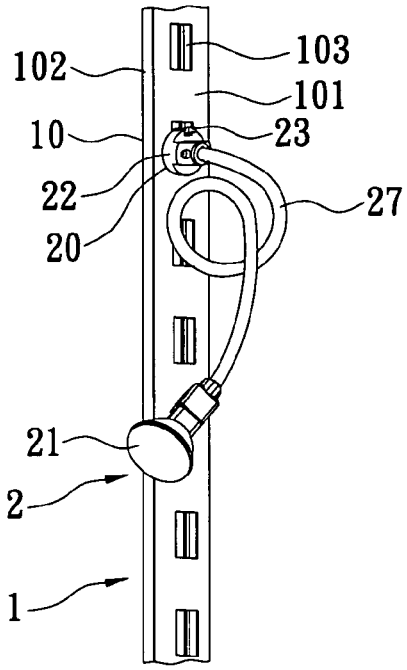
FIG. 3 is a perspective view of the track lamp assembly.

Referring to FIGS. 1–3, a track lamp assembly of the present invention includes a track subassembly 1 and a track lamp 2.

The track subassembly 1 includes a track 10, a pair of insulating bushings 11 and a pair of electrically conductive strips 12. The track 10 has a base 101 and a pair of L-shaped sidewalls 102 extending from opposite side edges of the base 101. A pair of ribs 104 respectively extends from the base 101 adjacent to the sidewalls 102, thereby defining a securing recess 105 between each sidewall 102 and each corresponding rib 104. A pair of protrusions 106 respectively extends from the free ends of the sidewalls 102 towards the base 101. The insulating bushings 11 are respectively assembled on the sidewalls 102. The electrically conductive strips 12 are respectively received in the insulating bushings 11. In this embodiment, each insulating bushing 11 has a securing flange 111 for being securely received in the securing recess 105. Each insulating bushing 11 is positioned between the rib 104 and the protrusion 106. A plurality of elongate holes 103 is defined in the base 101 along a longitudinal direction of the track 10.

The track lamp 2 includes an adapter 20 and a lamp holder 21. The adapter 20 includes a body 22, a resilient tab 23 attached to the periphery of the body 22, a post 24 extending from an upper surface of the body 22 opposite the lamp holder 21, a pair of securing boards 25 oppositely extending from side annular surfaces of the post 24, and a pair of contacts 26. The lamp holder 21 connects with the adapter 20 through a flexible pipe 27 or a pivotable mechanism (not shown in drawing). The resilient tab 23 has an engaging end 231 projecting from the upper surface of the body 22. A gap 28 is defined between the securing boards 25 and the upper surface of the body 22. One end of each contact 26 projects from the side surface of the post 24 above the corresponding securing board 25, and the other end of each contact 26 electrically connects with the lamp-house of the lamp holder 21.

In assembly of the track lamp 2 and the track subassembly 1, the resilient tab 23 of the adapter 20 is depressed to move the engaging end 231 downwards. The securing boards 25 of the adapter 20 are aligned with the elongate hole 103 of the track 10 and then the post 24 extends into the elongate hole 103. The body 22 of the adapter 20 is rotated to rotate the upper surface of the body 22 and the securing boards 25 to receive the base 101 of the track 10 in the gap 28. The engaging end 231 of the resilient tab 23 engages with the elongate hole 103, thereby stably positioning the adapter 20 on the track subassembly 1. The contacts 26 are respectively connected with the electrically conductive strips 12. Thus, the track lamp assembly of the present invention is provided.

In disassembly, the resilient tab 23 is depressed to downwards move the engaging end 231. The body 22 of the adapter 20 is rotated for rotating the securing boards 25 to align with the elongate hole 103 of the track 10. The post 24 is drawn from the elongate hole 103. Thus, the track lamp 2 is detached from the track subassembly 1.

Figure 4:
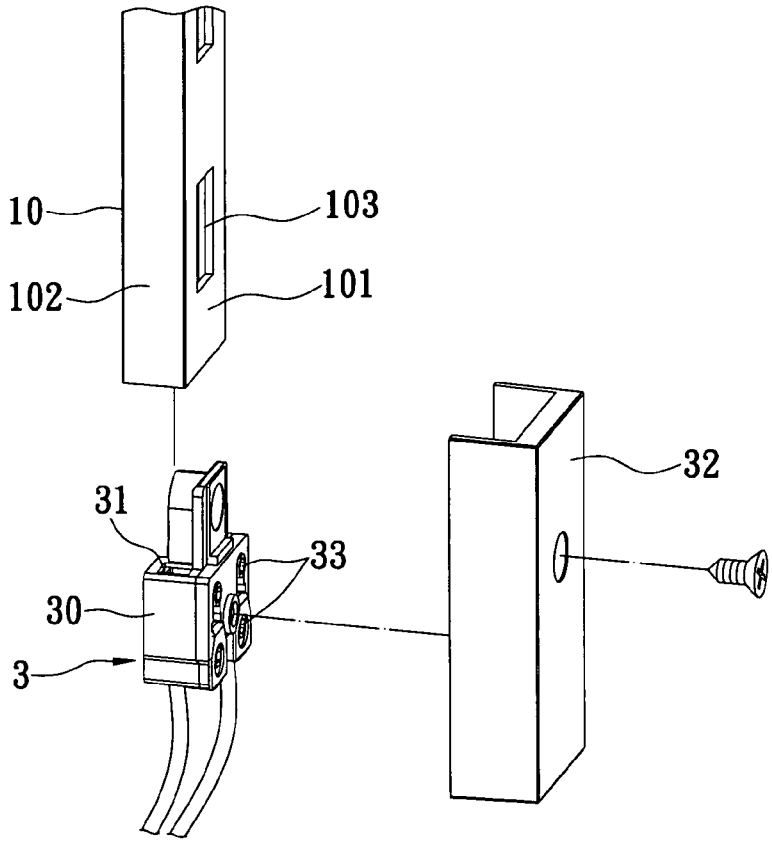
FIG. 4 is an exploded view showing a track subassembly and a power connector.

Referring to FIG. 4, the track lamp assembly of the present invention further includes a power connector 3. The power connector 3 includes an insulating housing 30, two electrically conductive members 31 and a casing 32. One end of each of electrically conductive members 31 is connected with one end of each of the electrically conductive strips 12 through a screw 33. The other end of each of the electrically conductive members 31 is connected with an external wire (not labeled) through another screw 33. Alternatively, the power connector 3 is replaced with another adapter 20, which connects with external wires through the contacts 26 thereof.

Figure 5:
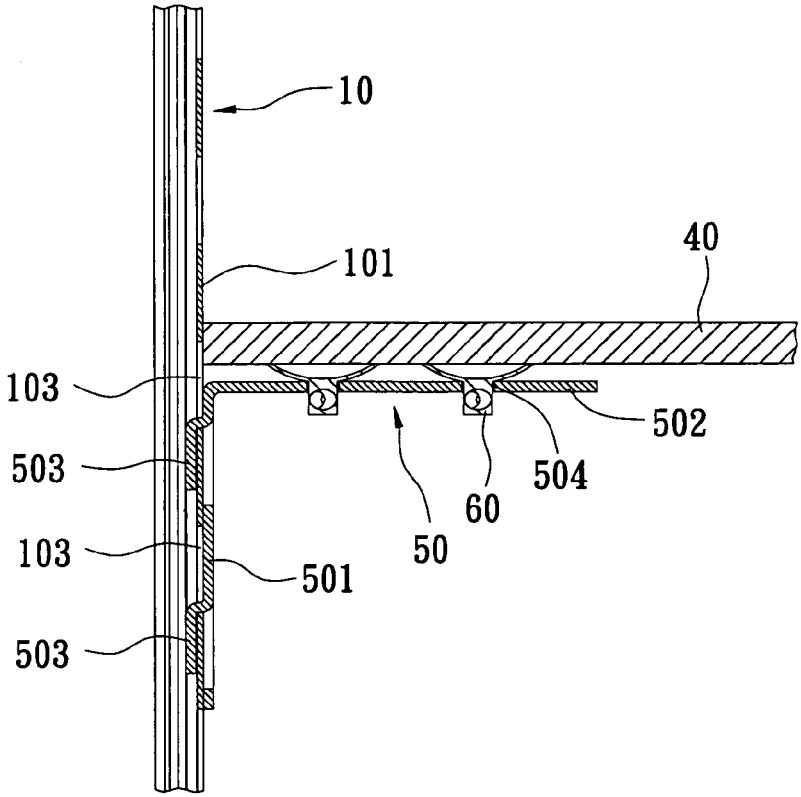
FIG. 5 is a cross-sectional view of a display with a track lamp assembly in accordance with a first embodiment of the present invention.

Referring to FIG. 5, a display in accordance with a first embodiment of the present invention includes a plurality of the above-mentioned track subassemblies 1, a plurality of support mechanisms, a shelf 40 and a plurality of the above-mentioned track lamps 2. For ease of description, the shown frame is partially shown in FIG. 5.

Each support mechanism engages with one of the elongate holes 103 in the track 10 of the track subassembly 1, thereby fixing the support mechanism to the track subassembly 1. In this embodiment, each support mechanism includes an L-shaped bracket 50 and a plurality of positioning members 60. The L-shaped bracket 50 has a vertical arm 501 and a horizontal arm 502 connected to the vertical arm 501. A pair of fingers 503 extends from the vertical arm 501 for extending through the elongate holes 103 of the track 10 and engaging with the base 101 of the track 10, whereby the base 101 of the track 10 is secured between the fingers 503 and the vertical arm 501. A pair of fixing holes 504 is defined in the horizontal arm 502 for fixing the positioning members 60 therein.

The shelf 40 is positioned on the positioning members 60 of the support mechanisms. In this embodiment, the shelf 40 is a plate of glass. Each positioning member 60 is a suction cup. The fringe of the shelf 40 is absorbed to position at the support mechanisms through the positioning members 60.

Each track lamp 2 is attached to one of the elongate holes 103 of the track 10 of the track subassembly 1 (as shown in FIG. 3).

Since the track lamps 2 and the support mechanisms are attached to the base 101 of the track 10 of the track subassembly 1 through the plurality of elongate holes 103 of the base 101, the track lamp assembly is readily assembled to form the display with a good shape.

Figure 6:
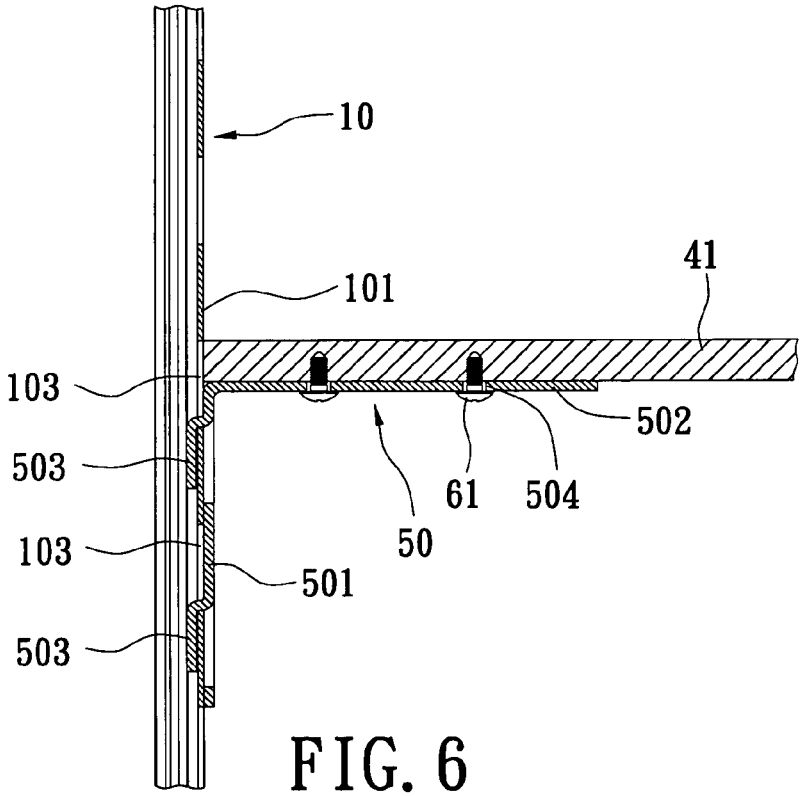
FIG. 6 is a cross-sectional view of a display with a track lamp assembly in accordance with a second embodiment of the present invention.

Referring to FIG. 6, a display in accordance with a second embodiment of the present invention is shown. Each support mechanism includes an L-shaped bracket 50 and a plurality of positioning members 61. The shelf 41 is a wood block. Each positioning member 61 is a screw. The fringe of the shelf 41 is screwed into position at the support mechanisms through the positioning members 61.

Figure 7:
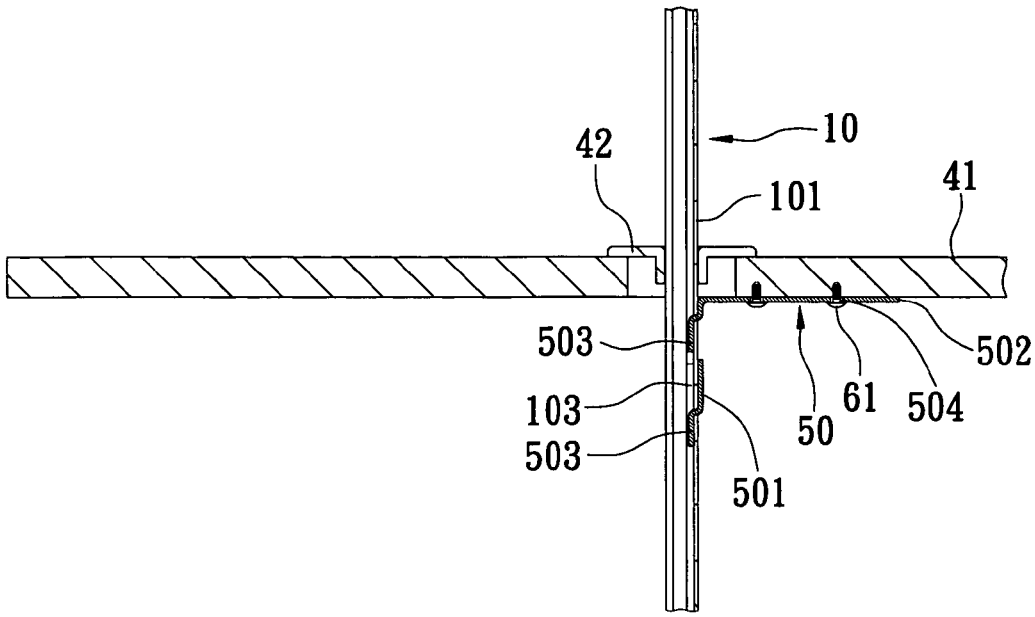
FIG. 7 is a cross-sectional view of a display with a track lamp assembly in accordance with a third embodiment of the present invention.
Figure 8:
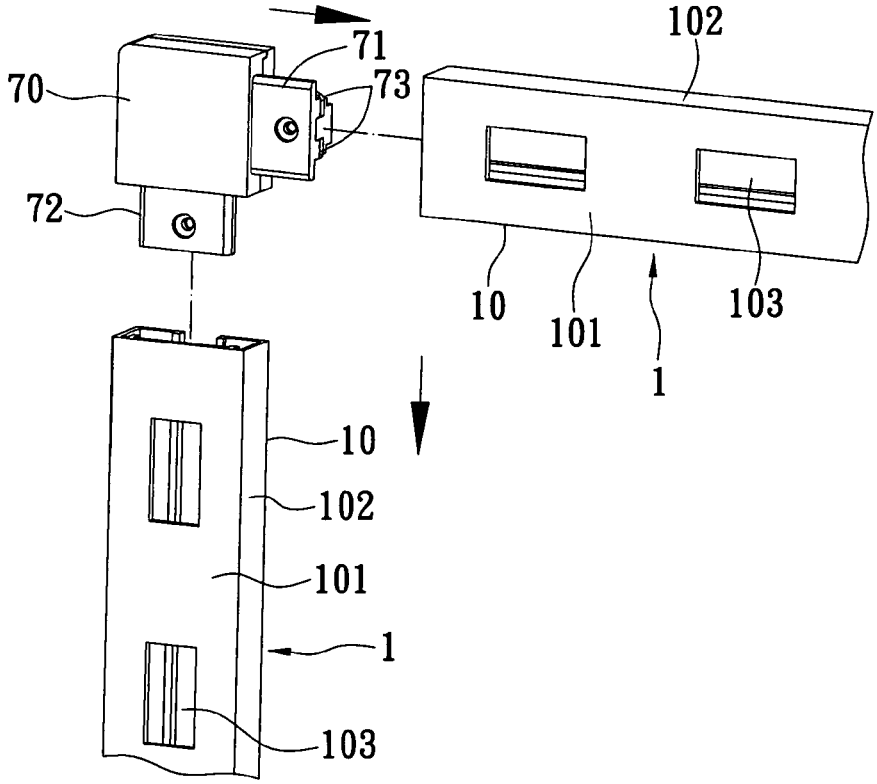
FIG. 8 is a partially exploded view of the display with a track lamp assembly in accordance with a third embodiment of the present invention.
Figure 9:
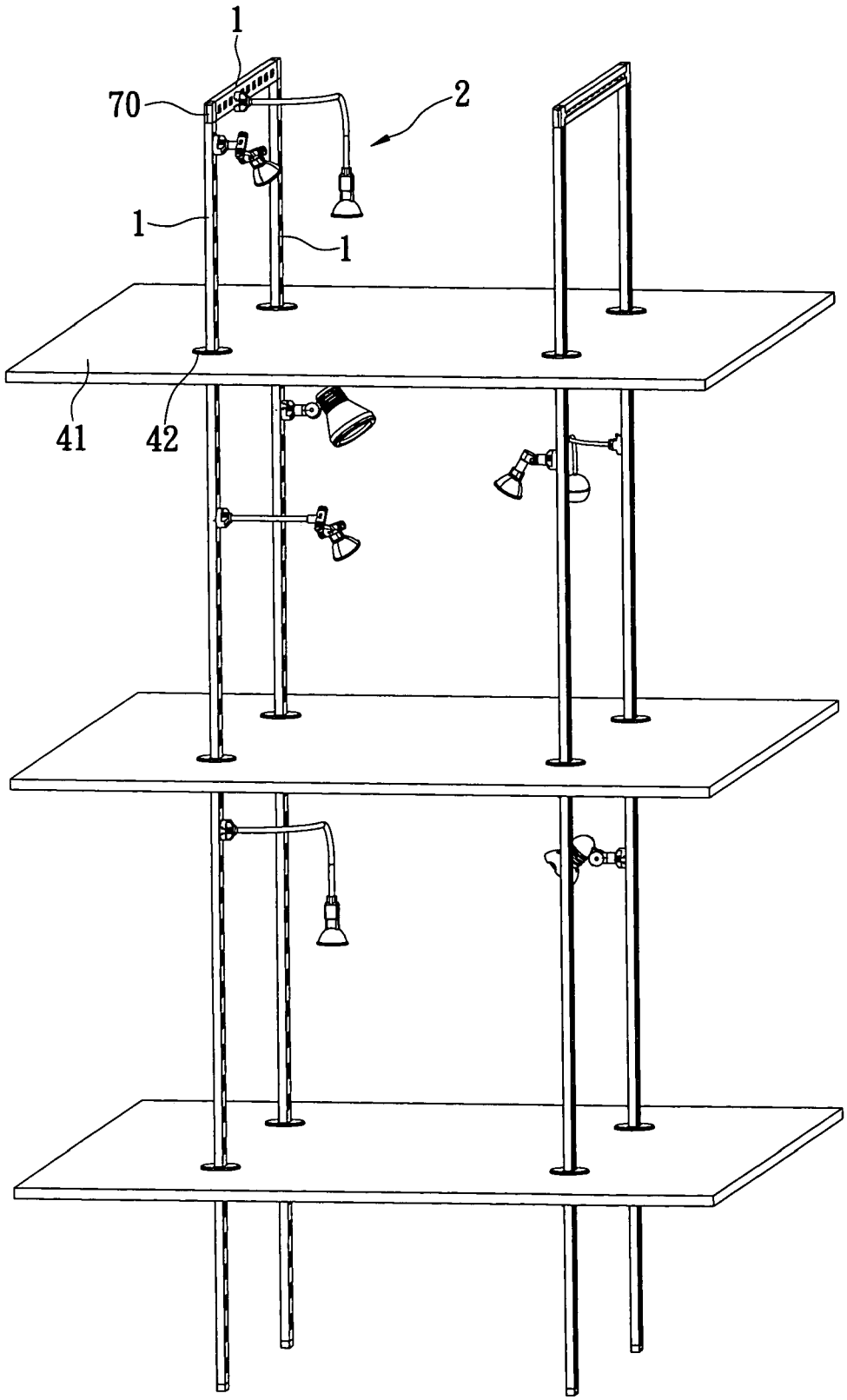
FIG. 9 is an assembled view of the display with a track lamp assembly in accordance with a third embodiment of the present invention.

Referring to FIGS. 7–9, a display with a track lamp assembly in accordance with a third embodiment of the present invention includes two groups of three track subassemblies 1 and two bidirectional connectors 70, a plurality of support mechanisms, a plurality of shelves 40 and a plurality of track lamps 2. The three track subassemblies include one horizontal track subassembly 1 and two vertical track subassemblies 1. Each bidirectional connector 70 includes a horizontal portion 71 and a vertical portion 72. Each bidirectional connector 70 also includes two electrically conductive members 73, each with both ends thereof respectively exposed to the horizontal and vertical portions 71, 72. The opposite ends of the horizontal track subassembly 1 connect with the horizontal portions 71 with the electrically conductive strips 12 thereof respectively connecting with the electrically conductive members 73. The vertical portion 72 connects with an end of each of the vertical track subassemblies 1 with the electrically conductive members 73 thereof respectively connecting with the electrically conductive strips 12. Thus, the three track subassemblies 1 and two bi-directional connectors 70 form a reversed U-shaped structure with a shared electric path defined by the electrically conductive strips 12 and the electrically conductive members 73. In this embodiment, the elongate holes 103 of the adjacent track subassemblies 1 are located in the same plane. Each support mechanism includes an L-shaped bracket 50 and a plurality of positioning members 61. The brackets 50 are respectively attached to the corresponding elongate holes 103 of the vertical track subassemblies 1 in the same plane. The positioning members 61 are screws. Each shelf 41 is a wood block with a seal member 42 received therein. The vertical track subassemblies 1 extend through the seal members 42. Therefore, the fringe of the shelf 41 is not limited to being located at one side of the track subassembly 1.

Figure 10:
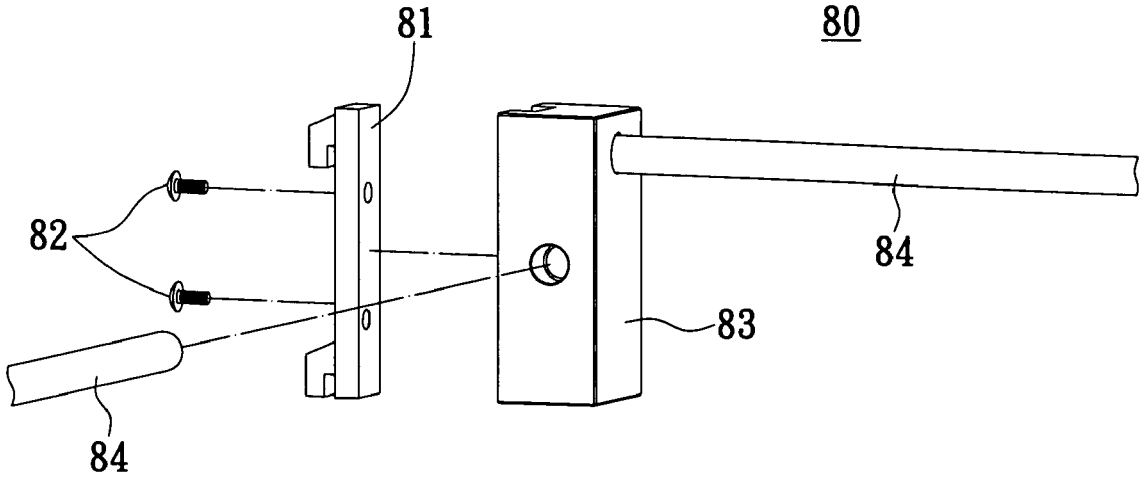
FIG. 10 is a partially exploded view of a display with a track lamp assembly in accordance with a fourth embodiment of the present invention.
Figure 11:
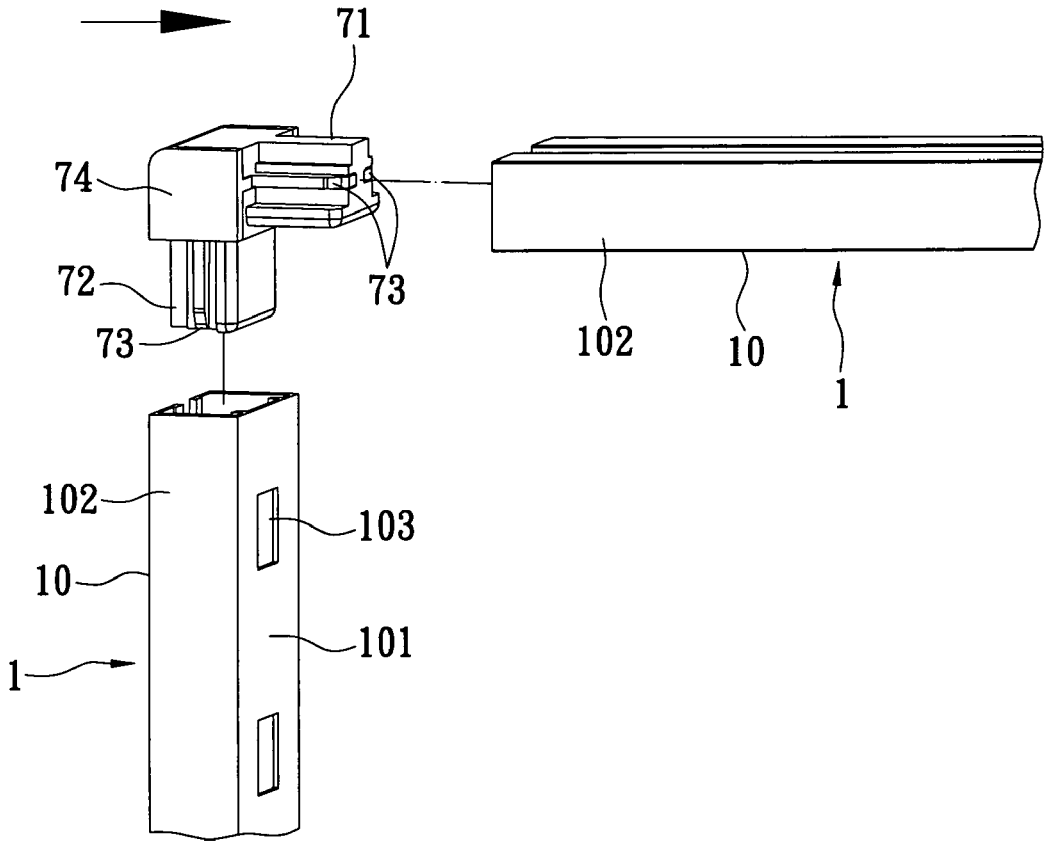
FIG. 11 is another partially exploded view of the display with a track lamp assembly in accordance with a fourth embodiment of the present invention.
Figure 12:
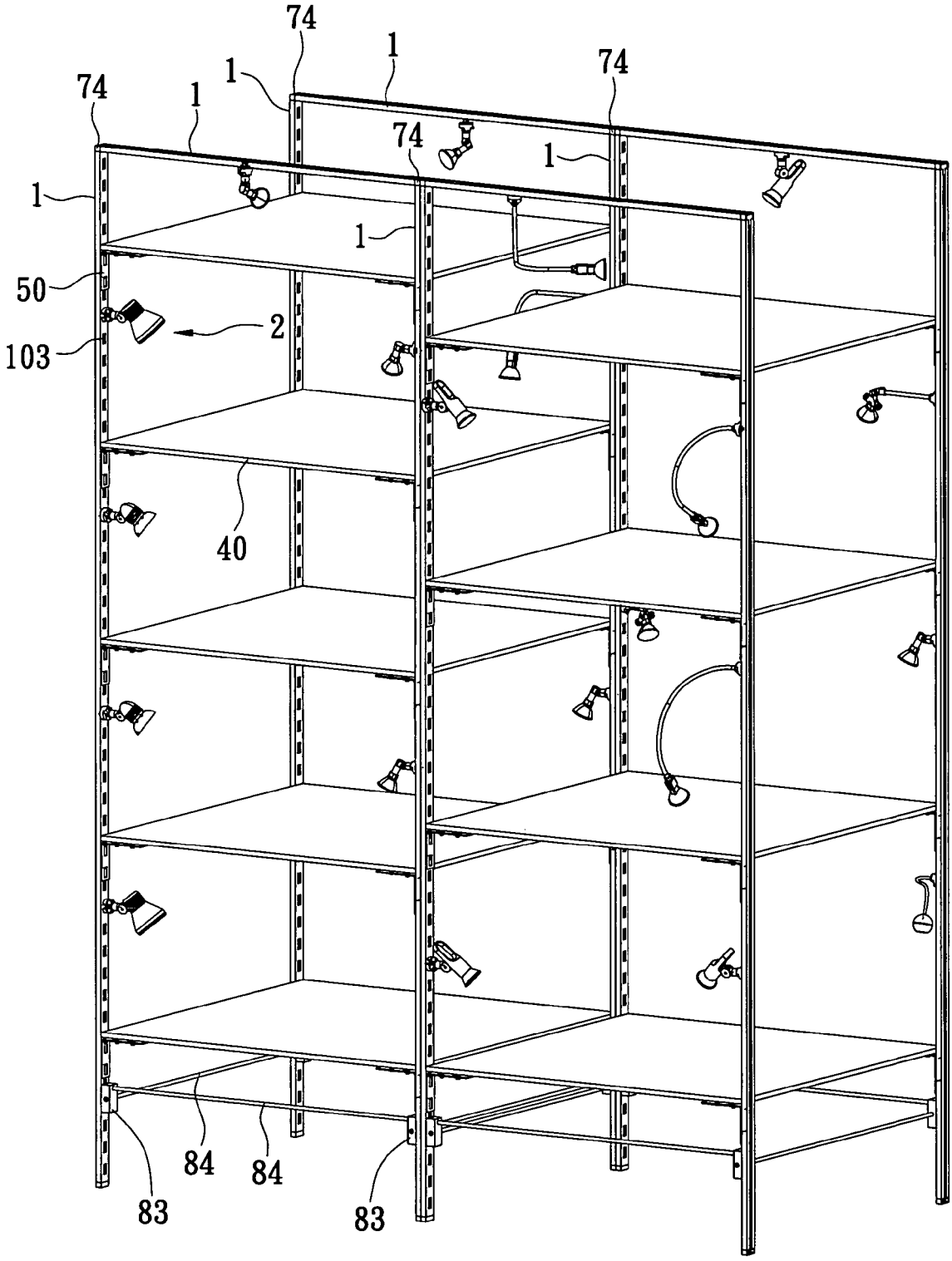
FIG. 12 is an assembled view of the display with a track lamp assembly in accordance with a fourth embodiment of the present invention.

Referring to FIGS. 10–12, a display with a track lamp assembly in accordance with a fourth embodiment of the present invention includes six track subassemblies 1, four bi-directional connectors 74, a strengthening mechanism 80, a plurality of support mechanisms, a plurality of shelves 40 and a plurality of track lamps 2. The assembly of the support mechanisms, the shelves 40 and the track lamps 2 are the same as that of the first embodiment. The six track subassemblies include two horizontal track subassemblies 1 and four vertical track subassemblies 1. The bi-directional connectors 74 are the same as those of the third embodiment. One horizontal track subassembly 1, two vertical track subassemblies 1 and two bi-directional connectors 74 form a reversed U-shaped structure. In this embodiment, the elongate holes 103 of the adjacent track subassemblies 1 are located in different planes. The strengthening mechanism 80 includes four attaching members 81, a plurality of fixing members 82, four supporting members 83 and four rods 84. The attaching members 81 are fixed to the supporting members 83 respectively through the fixing members 82. The attaching members 81 engage with the elongate holes 103 of the track subassembly 1 and are located in the same plane. Each rod 84 is connected between the supporting members 83. Thus, the display is strengthened.

Figure 13:
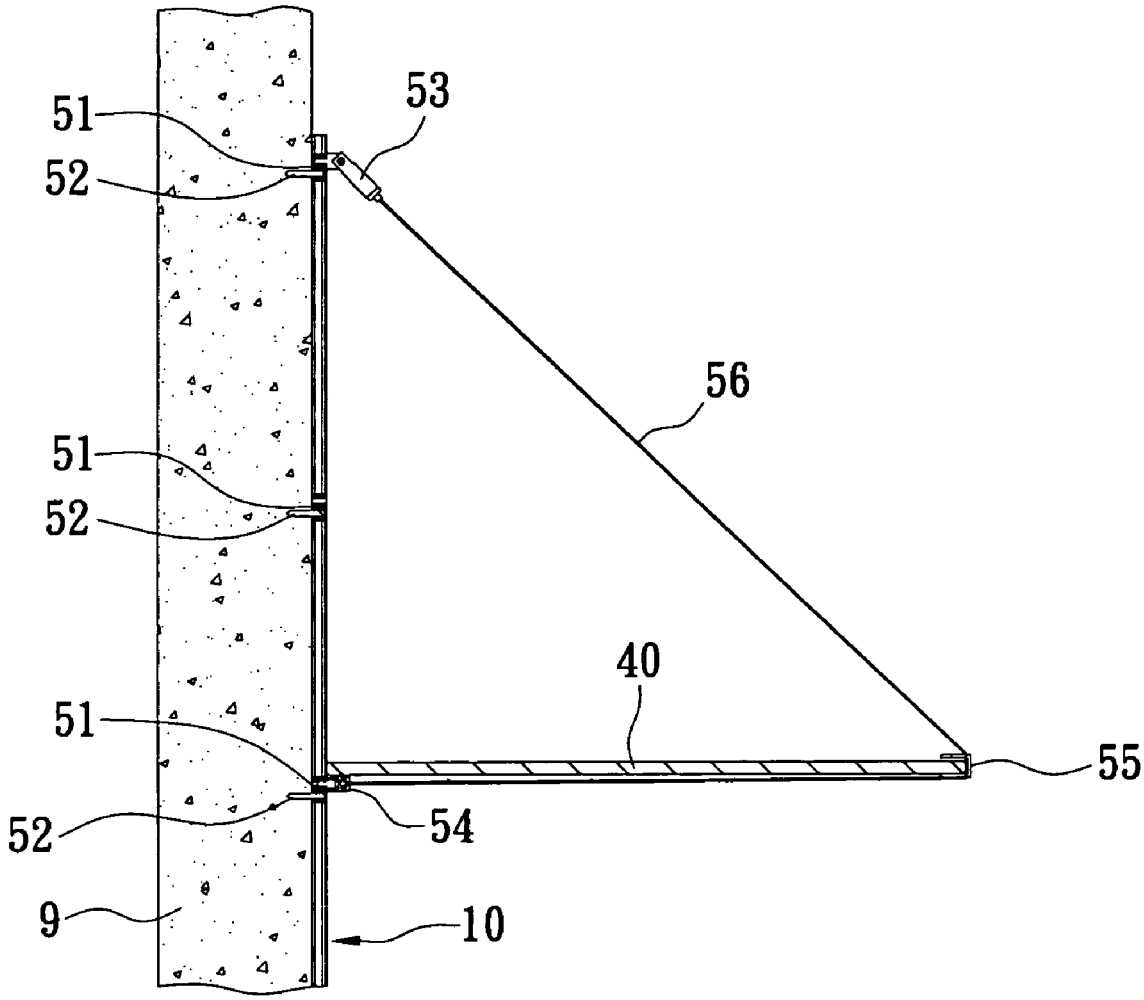
FIG. 13 is a partially cross-sectional view of a display with a track lamp assembly in accordance with a fifth embodiment of the present invention.
Figure 14:
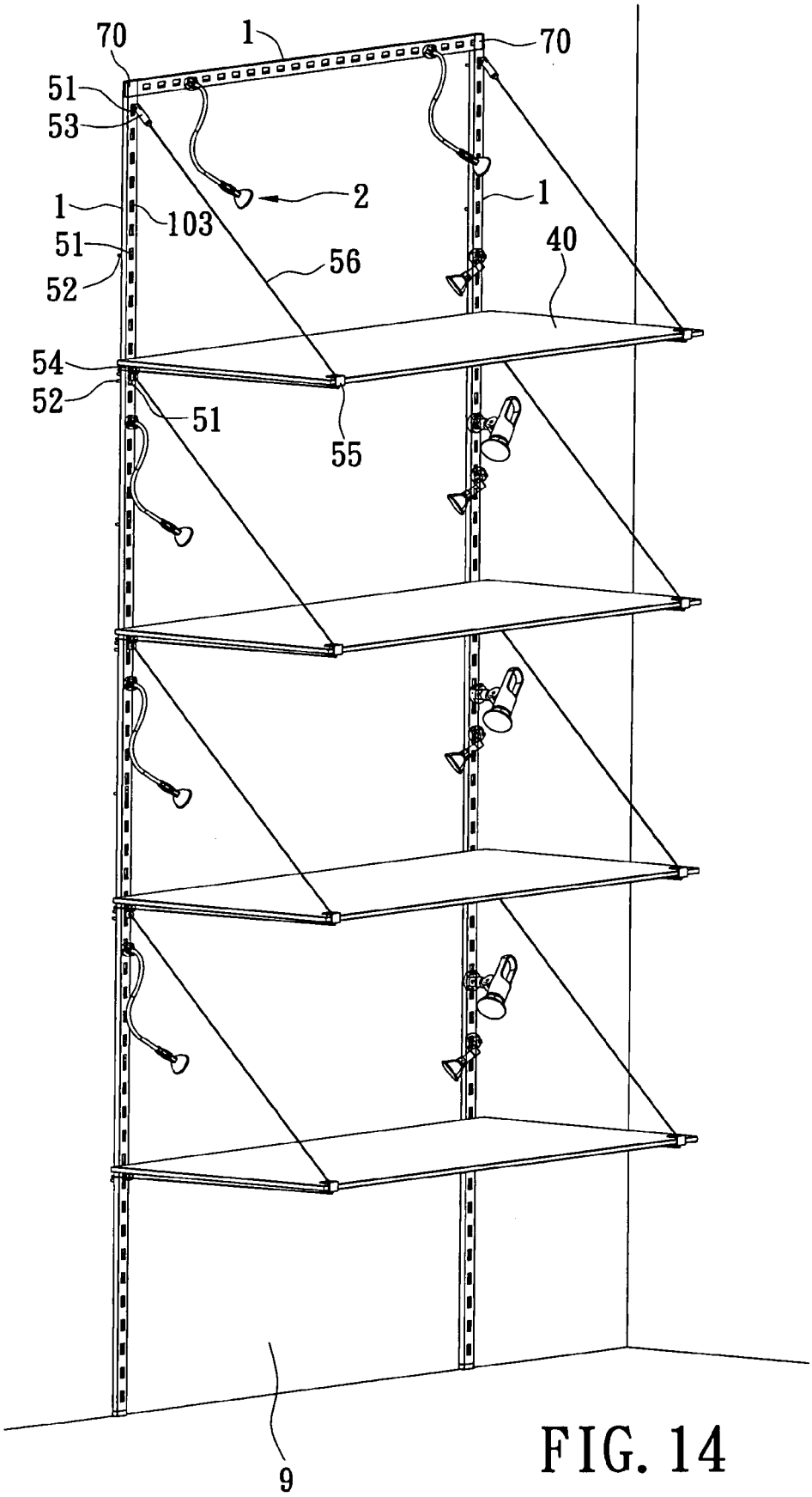
FIG. 14 is an assembled view of the display with a track lamp assembly in accordance with a fifth embodiment of the present invention.

Referring to FIGS. 13–14, a display with a track lamp assembly in accordance with a fifth embodiment of the present invention includes three track subassemblies 1, two bi-directional connectors 70, a plurality of support mechanisms, a plurality of shelves 40 and a plurality of track lamps 2. The assembly of the track subassemblies 1, the bi-directional connectors 70 and the track lamps 2 are the same as that of the third embodiment. Each support mechanism at least includes two insertion members 51, two fixing members 52, an upper connection member 53, a lower connection member 54, a clip 55 and a line 56. The insertion members 51 are respectively inserted into the elongate holes 103 of the track 10 and fixed to an attaching surface 9, such as a wall by the fixing members 52. The upper and lower connection members 53, 54 are respectively connected to the insertion members 51. One end of the line 56 connects to the lower connection member 54, and the other end of the line 56 extends through the clip 55 and connects to the upper connection member 53. The opposite edges of the shelf 40 are positioned at the lower connection members 54 and the clips 55. Thus, the display is fixed to the attaching surface 9.

Figure 15:
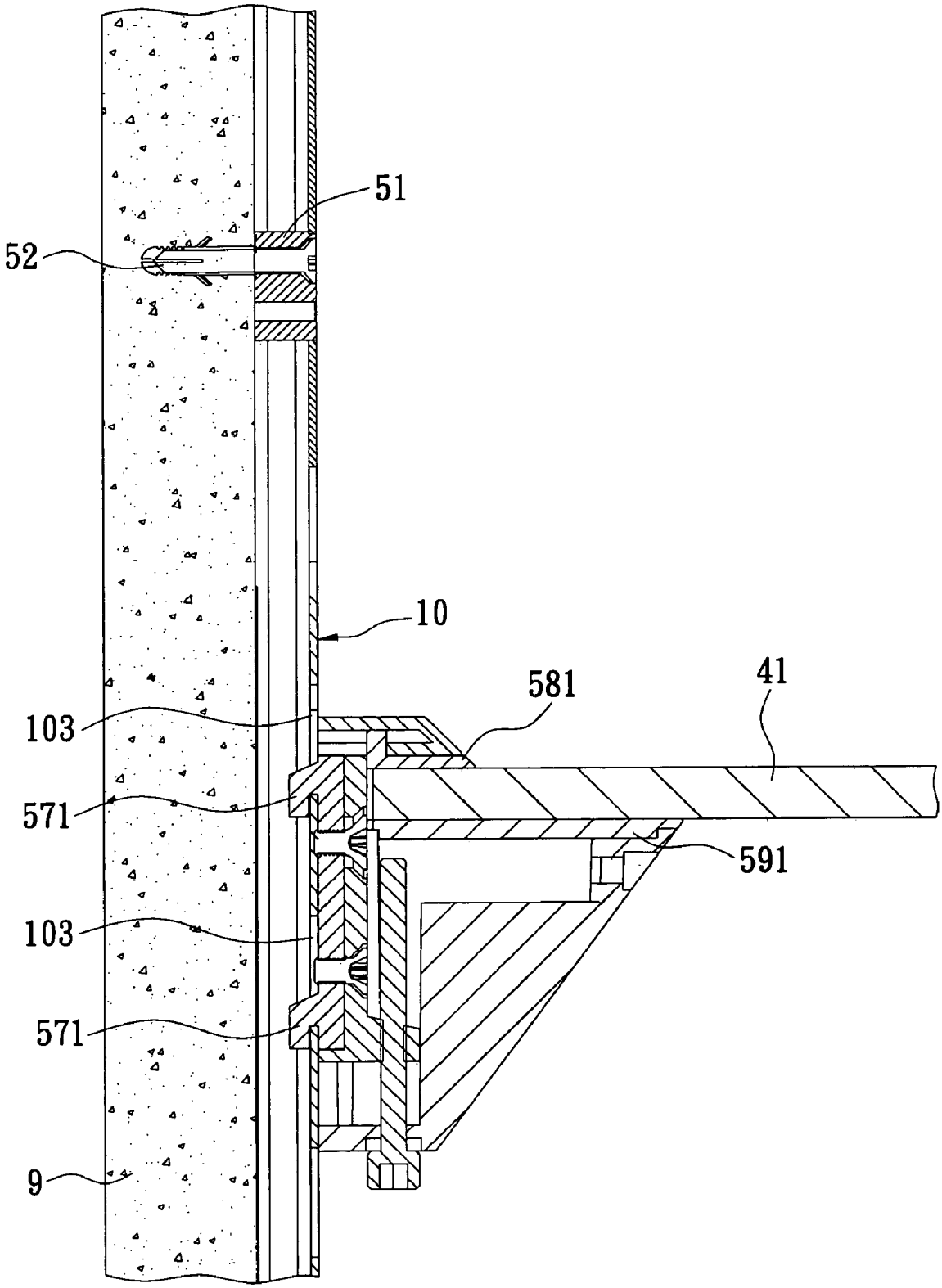
FIG. 15 is a partially cross-sectional view of a display with a track lamp assembly in accordance with a sixth embodiment of the present invention.
Figure 16:
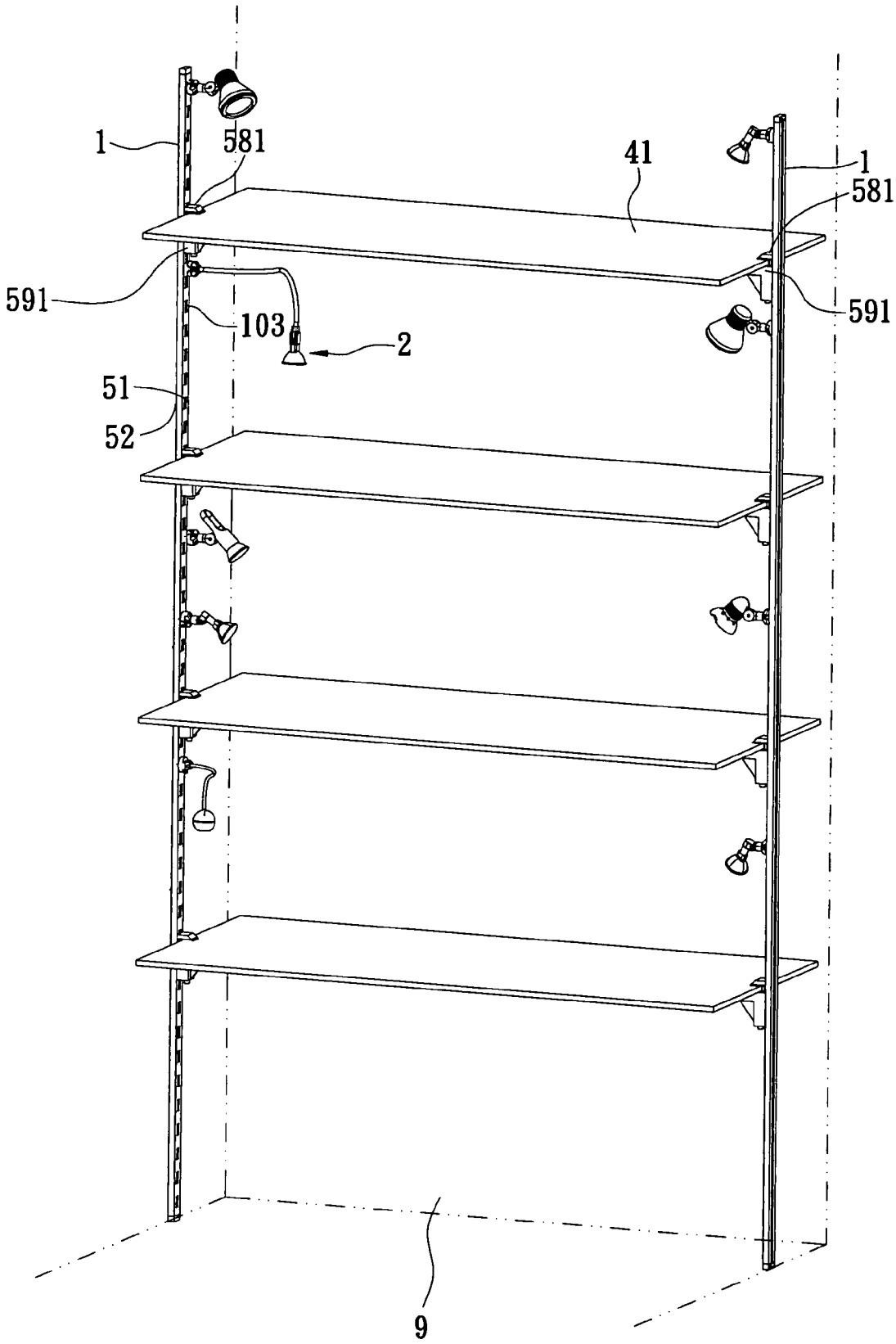
FIG. 16 is an assembled view of the display with a track lamp assembly in accordance with a sixth embodiment of the present invention.

Referring to FIGS. 15–16, a display with a track lamp assembly in accordance with a sixth embodiment of the present invention includes two track subassemblies 1, a plurality of support mechanisms, a plurality of shelves 41 and a plurality of track lamps 2. Each support mechanism includes an attaching member 571, a positioning member 581, and a support member 591. The attaching member 571 extends through the elongate holes 103 of the track 10 and engages with the base 101 of the track 10. The shelf 41 is positioned between the positioning member 581 and the support member 591. In addition, the display further includes a plurality of insertion members 51 and a plurality of fixing members 52. The insertion members 51 are respectively inserted into the elongate holes 103 of the track 10 and fixed to an attaching surface 9, such as a wall, by the fixing members 52. Thus, the display is fixed to the attaching surface 9.

As mentioned above, the track lamp assembly and the display with the track lamp assembly of the present invention have advantages described as follows.

The track lamps and the support mechanisms are attached to the tracks through the plurality of elongate holes defined in the bases of the tracks of the track subassemblies, whereby the track lamp assembly is assembled to form the display. Thus, it is ready to assemble a display with a good shape.

The display can be assembled to different desired styles by selecting different support mechanisms. The electrically conductive strips of the adjacent track subassemblies are connected with each other through the bi-directional connectors, thereby forming a shared electric path.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A track lamp assembly comprising:

a track subassembly having a track, a pair of insulating bushings and a pair of electrically conductive strips, the track having a base and a pair of sidewalls respectively extending from opposite side edges of the base, a plurality of elongate holes being defined in the base along a longitudinal direction of the track, the insulating bushings being respectively assembled to the sidewalls, the electrically conductive strips being respectively received in the insulating bushings; and a track lamp having an adapter, the adapter having a body, a post extending from an upper surface of the body, a pair of securing boards oppositely projecting from side annular surfaces of the post, and a pair of contacts, a gap being defined between the upper surface and the securing boards, and an end of each contact projecting from the side annular surface of the post above the securing board;

wherein the post extends into one of the elongate holes of the track, the base is secured between the upper surface of the body and the securing boards by rotating the body, and the contacts are electrically connected with the electrically conductive strips, respectively.

2. The track lamp assembly as claimed in claim 1, wherein a pair of ribs extends from the base of the track, a securing recess is defined between each of the ribs and a corresponding one of the sidewalls, a protrusion extends from a free end of each sidewall, a securing flange extends from each of the insulating bushings and is securely received in the securing recess, and the insulating bushings are respectively positioned between the ribs and the protrusions.

3. The track lamp assembly as claimed in claim 1, wherein the adapter includes a resilient tab attached to a periphery of the body, the resilient tab has an engaging end projecting from the upper surface of the body, and when the base is secured between the upper surface of the body and the securing boards, the engaging end of the resilient tab engages with a corresponding elongate hole.

4. A display with a track lamp assembly, comprising:

a track subassembly having a track, the track having a base, and a plurality of elongate holes being defined in the base along a longitudinal direction of the track;

a support mechanism attached to some of the elongate holes of the tracks wherein the support mechanism includes an L-shaped bracket and a positioning member, the bracket has a vertical arm and a horizontal arm connecting with the vertical arm, a finger extends from the vertical arm for extending into one of the elongate holes of the track, thereby securing the base of the track between the finger and the vertical arm, a fixing hole is defined in the horizontal arm for fixing the positioning member therein;

a shelf positioned on the positioning member; and a track lamp attached to one of the elongate holes of the track.

5. The display with a track lamp assembly as claimed in claim 4, wherein a sealing member is attached to the shelf, and the track subassembly extends through the sealing member.

6. The display with a track lamp assembly as claimed in claim 4, comprising three track subassemblies and two bi-directional connectors, wherein the three track subassemblies include a horizontal track subassembly and two vertical track subassemblies, each bi-directional connector has a horizontal portion and a vertical portion, each bi-directional connector includes two electrically conductive members, both ends of each of the electrically conductive members are respectively exposed to the horizontal and vertical portions, opposite ends of the horizontal track subassembly connect with the horizontal portions with the electrically conductive strips thereof respectively connecting with the electrically conductive members of the bi-directional connectors, and the vertical portion connects with an end of each of the vertical track subassemblies with the electrically conductive members thereof respectively connecting with the electrically conductive strips of the vertical track subassemblies.

7. The display with a track lamp assembly as claimed in claim 4, comprising six track subassemblies, four bi-directional connectors and a strengthening mechanism, wherein the six track subassemblies include two horizontal track subassemblies and four vertical track subassemblies, one horizontal track subassembly, two vertical track subassemblies and two bi-directional connectors form a reversed U-shaped structure, the strengthening mechanism includes four attaching members, a plurality of fixing members, four supporting members and four rods, the attaching members are fixed to the supporting members respectively through the fixing members, the attaching members engage with the elongate holes of the track subassembly, and each rod is connected between the supporting members.

8. The display with a track lamp assembly as claimed in claim 4, wherein the support mechanism includes two insertion members, two fixing members, an upper connection member, a lower connection member, a clip and a line, the insertion members are respectively inserted into the elongate holes of the track and fixed to an attaching surface by the fixing members, the upper and lower connection members are respectively connected to the insertion members, one end of the line connects to the lower connection member, another end of the line extends through the clip and connects to the upper connection member, and the shelf is positioned on the lower connection members and the clips.

9. The display with a track lamp assembly as claimed in claim 4, wherein the support mechanism includes an attaching member, a positioning member and a support member, the attaching member extends into the elongate holes of the track and engages with the base of the track, and the shelf is positioned between the positioning member and the support member.

* * * * *